US008535251B1

(12) United States Patent
Rao

(10) Patent No.: US 8,535,251 B1
(45) Date of Patent: Sep. 17, 2013

(54) MECHANICAL DEVICE TO ASSIST IN THE EXTERNAL COMPRESSION OF THE CHEST DURING CARDIO-PULMONARY RESUSCITATION

(76) Inventor: Subhakar Patthi Rao, Thousand Oaks, CA (US)

( * ) Notice: Subject to any disclaimer, the term of this patent is extended or adjusted under 35 U.S.C. 154(b) by 276 days.

(21) Appl. No.: 13/079,685

(22) Filed: Apr. 4, 2011

(51) Int. Cl.
*A61H 31/00* (2006.01)
*A61H 31/02* (2006.01)

(52) U.S. Cl.
USPC ..... 601/41

(58) Field of Classification Search
USPC ..... 601/41–44; 128/202.28, 202.29, 128/203.11
See application file for complete search history.

(56) References Cited

U.S. PATENT DOCUMENTS

| | | | | | |
|---|---|---|---|---|---|
| 2,699,163 | A | | 1/1955 | Engstrom et al. | |
| 3,219,031 | A | * | 11/1965 | Rentsch, Jr. | 601/97 |
| 3,425,409 | A | * | 2/1969 | Max et al. | 601/41 |
| 3,739,771 | A | * | 6/1973 | Gaquer et al. | 601/97 |
| 3,782,371 | A | * | 1/1974 | Derouineau | 601/41 |
| 3,965,893 | A | * | 6/1976 | Ragailler | 601/106 |
| 3,985,126 | A | | 10/1976 | Barkalow | |
| 4,233,980 | A | * | 11/1980 | McRae et al. | 606/201 |
| 4,349,015 | A | | 9/1982 | Alferness | |
| 4,570,615 | A | | 2/1986 | Barkalow | |
| 4,632,094 | A | | 12/1986 | Thomas | |
| 5,184,606 | A | * | 2/1993 | Csorba | 601/41 |
| 5,257,619 | A | * | 11/1993 | Everete | 601/41 |
| 5,327,887 | A | * | 7/1994 | Nowakowski | 128/204.21 |
| 5,454,779 | A | | 10/1995 | Lurie et al. | |
| 5,490,820 | A | | 2/1996 | Schock et al. | |
| 5,645,522 | A | | 7/1997 | Lurie et al. | |
| 5,891,062 | A | | 4/1999 | Schock et al. | |
| 5,913,837 | A | * | 6/1999 | Smith | 601/41 |
| 6,066,106 | A | | 5/2000 | Sherman et al. | |
| 6,213,960 | B1 | | 4/2001 | Sherman et al. | |
| 6,447,465 | B1 | | 9/2002 | Sherman et al. | |
| 6,645,163 | B2 | | 11/2003 | Kelly et al. | |
| 6,648,841 | B1 | * | 11/2003 | Sessler | 601/41 |
| 6,939,314 | B2 | | 9/2005 | Hall et al. | |
| 7,108,665 | B2 | | 9/2006 | Halperin et al. | |
| 7,118,542 | B2 | | 10/2006 | Palazzoco et al. | |
| 7,211,056 | B2 | | 5/2007 | Petelenz et al. | |
| 7,226,427 | B2 | | 6/2007 | Steen | |
| 7,347,832 | B2 | | 3/2008 | Jensen et al. | |
| 7,666,153 | B2 | | 2/2010 | Hall et al. | |
| 2006/0084892 | A1 | | 4/2006 | Lenhart et al. | |
| 2009/0234255 | A1 | * | 9/2009 | Votel | 601/41 |
| 2010/0198117 | A1 | | 8/2010 | Itai et al. | |
| 2010/0198118 | A1 | * | 8/2010 | Itnati | 601/41 |

* cited by examiner

*Primary Examiner* — Kristen Matter

(57) ABSTRACT

A portable mechanical device to assist in external chest compressions during cardio-pulmonary resuscitative procedures. The embodiment consists of a frame (100), a plunger unit (104) and an articulating lever (109). The bottom member (102) of the frame is positioned under the subject such that the dome of the plunger unit (104) rests above the mid-sternal region. The handle (108) at the free end of the lever is used to apply downward force by the life-saver to provide the necessary chest compressions. The device is light in weight, easily transportable, and has an indefinite shelf life. This device is designed to be used by anyone with a basic training in CPR. The portability of the device renders itself useful outside the environs of a hospital, in confined quarters, and at remote locations.

6 Claims, 17 Drawing Sheets

MECHANICAL DEVICE TO ASSIST IN THE EXTERNAL COMPRESSION OF THE CHEST DURING CARDIO-PULMONARY RESUSCITATION

BACKGROUND

Prior Art

U.S. Pat. No. 5,184,606 issued to George Csorba on Feb. 9, 1993

U.S. Pat. No. 5,257,619 issued to Randall L. Everette on Nov. 2, 1993

The standard protocol for a 'Cardiac arrest' outside the hospital environment has been external chest compressions with intermittent forced mouth-to-mouth respiration till recovery of the subject or the arrival of additional help or with a tragic ending. Retrospective studies have shown that this method has not been effective in saving lives. Excessive ventilation, incomplete chest wall recoil, and interruptions in chest compressions in the traditional CPR do not improve the blood flow to the heart, brain etc. This worsens the chances of survival and increase the possibility of brain damage. New guidelines given by the American Heart Association in 2010 recommends high quality chest compressions to a depth of two inches for an adult and at the rate of 100 per minute in an effort to restore flow of oxygenated blood to the brain and the heart. This maneuver may delay the onset of tissue death and extend the brief window of opportunity for a successful resuscitation. These new guidelines also keeps the heart in a more receptive stage for the electric shock that is used to defibrillate and jump start the heart in certain rhythm abnormalities like ventricular fibrillation or ventricular tachycardia.

The need to provide approximately 100 compressions a minute demands the CPR provider to be in fairly good physical condition to sustain the procedure till the subject recovers or till help arrives or for another bystander to take over the compressions without interruptions. At present there are a few automated devices that do provide the required compressions by using compressed air, oxygen or a system of thoracic wraps that work with the help of motors etc. These devices are recommended to be used by the EMT personnel or in a hospital.

The inventions bearing U.S. Pat. Nos. 5,184,606 and 5,257,619 are mechanical devices that use physical effort by the life-saver to perform chest compressions during CPR. The design of these devices is broadly based on the principle of class 2 levers albeit with minimal mechanical advantage. There is a fulcrum at one end of a beam, a chest pad in the middle and the physical effort is provided at the other end. In this configuration there is minimal mechanical advantage and as such early life-saver fatigue is still an issue. There are no limits to check the depth for an effective compression or a guide for full chest recoil.

ADVANTAGES

The embodiment described herein is a manually operated mechanical device based on the time-tested principle of 'Class 2 Levers' and the resultant 'Mechanical Advantage', wherein the amount of effort needed to compress the chest to the required depth is a fraction of the effort needed to do the same without any devices. This makes it more usable for a trained lay person positioned beside a supine subject to render effective and sustained CPR and delay the onset of life-saver fatigue. The default chest compression depth is set to 2 inches. The embodiment also has user selectable options to reduce the chest compressions to accommodate smaller patients. Optionally an electronic metronome set at 100 beats per minute attached to the frame will give the life-saver an auditory cue to provide approximately the same number of chest compressions for an effective resuscitation.

SUMMARY

The embodiment addresses the need for a simple, effective, and economical device. The mechanical versions of the embodiment do not depend on any form of external energy other than a nominal physical effort by the CPR provider.

The embodiment consists of a rigid metal frame. The top member of the frame has the provision to receive a plunger unit that can be compressed repeatedly. The plunger unit has a central hollow plunger with a stem on the top. The height of the stem is designed to limit the downward travel to 2 inches. The lower end of the hollow plunger has a rigid collar that receives a nut. There is a flanged cap at the intersection of the stem and the plunger. The flange traps the upper end of a coil spring that resides inside a hollow rigid sleeve. The rigid sleeve has an upper flange that is attached to the under side of the top member of the rigid frame. The bottom end of the sleeve has lip that blocks the lower end of the coil spring. In this configuration when force is applied at the top of the stem, the plunger slides down the cylinder. When the same force is released the plunger retracts back.

A nut fixed inside the plunger receives a machine screw that travels inside the hollow plunger. The lower end of the machine screw is attached to a dome. The dome comes in contact with the sternum of the subject. The dome and the machine screw unit can be raised or lowered depending upon the chest height while the subject is in a supine position.

The anterior free end of the top member of the rigid frame has a set of articulating processes that mesh with similar complimentary processes found on a rigid lever forming an articulating hinge joint. This hinge joint constitutes the fulcrum of the class 2 levers. The lever has a linear ridge closer to the hinged portion going across the entire width. This ridge rests on the stem of the plunger unit. The free end of the lever is modified into a handle. The life saver uses this handle to exert downward force needed to depress the sternally placed dome and achieve the desired chest compressions. The caudal end of the rigid top member has a handle that can used to carry and transport the device.

The rigid frame has a bottom member that is longer than the top member. The free end of the top member and one end of the bottom member are attached to an upright member. The lower region of the upright member has a vertically positioned handle on the outside which is used by the life saver to slide and position the bottom member of the embodiment under the chest of the subject. A set of depth limiting blocks are hingedly attached to the top end of the upright member. These are used to reduce the plunger travel and thus the chest compression depth from the default 2 inches to either 1.75 inches or 1.5 inches.

DRAWINGS

REFERENCE NUMERALS

Figure 1A:
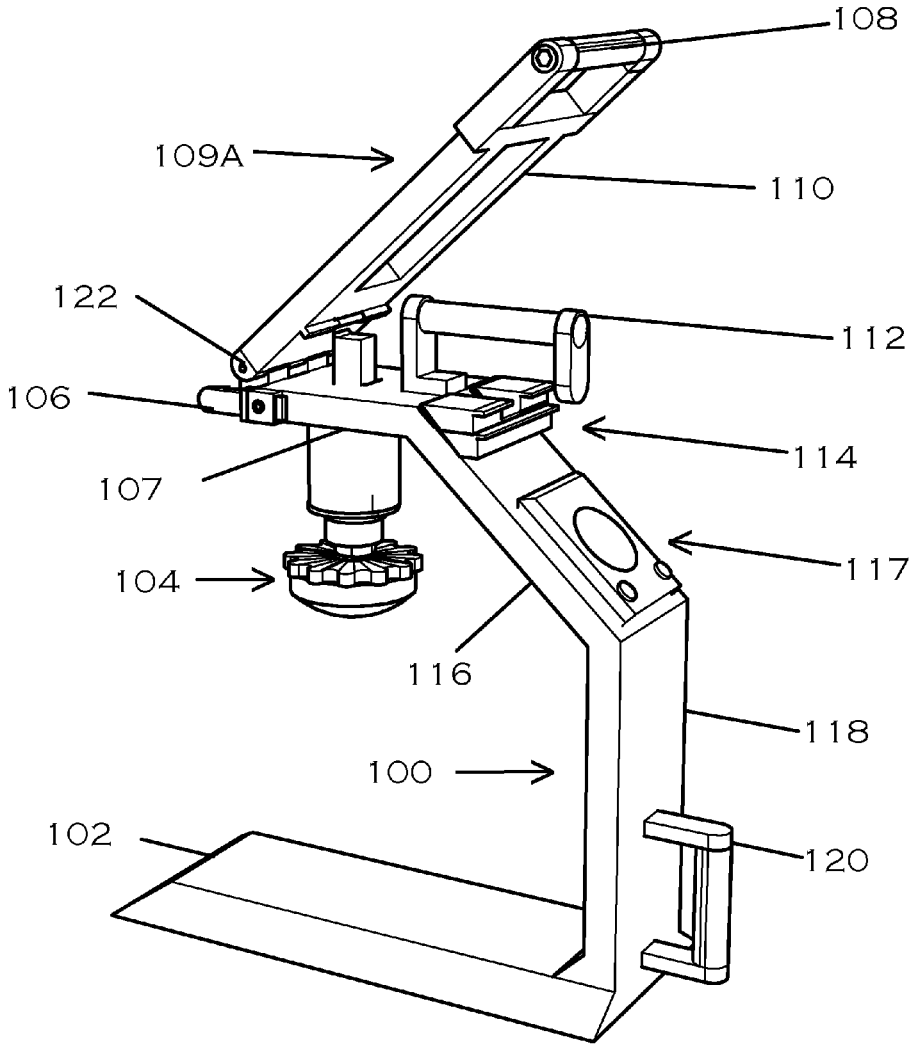
FIG. 1A shows an embodiment with a straight operating lever.

100, is the rigid frame.

102, is the base of the rigid main frame that is positioned under the chest of the subject

104, is the plunger unit that can be raised or lowered as needed.

106, is the lock tab to secure the side of the lever while being stored or transported.

107, is the top member of the rigid frame.

108, the rigid handle used by the life-saver to apply the necessary downward force.

109A, is the basic straight articulating lever.

109B, is the lever in the Z-configuration.

109C, is the primary lever in a two lever configuration.

109D, is the primary lever in a two lever configuration with a disk in the secondary lever.

110, is the body of the straight lever that shows a long open cavity in the middle for the clearance of the carrying handle during the compression phase.

110A, is the body of the Z-shaped lever that shows an open cavity in the middle for the clearance of the carrying handle during the compression phase.

112, is a rigid open handle that passes thru the open cavity of the body of the primary lever during the compression phase and is used to carry the device when the lever is rotated down into the storage position.

114, are a set of optional plunger depth limiting blocks when a desired depth of either 1.75 or 1.5 inches is desired instead of the default 2 inches.

116, is the angular part of the rigid upright frame that is contiguous with the top member of the main frame. The plunger depth limiting blocks are affixed to the top edge of the angular member by a pair of fully articulating hinges.

117, is an optional after-market electronic metronome attached to the lower region of the outer surface of the angular member with a hook and loop type of fastener. The metronome is set to give out audible tones at the rate of 100 beats per minute to help guide the life saver to provide approximately the same number of effective chest compressions.

118, is the upright member of the rigid frame that is contiguous with the lower end of the angular member and the base of the rigid frame.

120, is a vertically mounted handle at the lower region of the vertical member. The handle is used to slide and position the embodiment under the chest of the subject.

122, is the articulating hinge of the fulcrum comprising of meshing knuckles found on the anterior end of the top member of the rigid frame and the anterior end of the lever.

124, is the visible portion of the stem of the plunger unit.

126, is a modified version of the body of the primary lever found in the Z configuration.

128, another modified version of the body of the primary lever designed for an embodiment with two levers.

130, a rigid bearing located at the caudal end of the body of the primary lever.

132, a rigid rod that connects the primary and secondary levers.

134, a roller bearing located at the caudal end of the body of secondary lever.

136A & 136B, a pair guide rods that connects to a rigid handle at the distal end and the proximal ends slide in the two corresponding channels in the body of the secondary lever.

137, is the secondary lever pivotally attached to the primary lever 109.

138, a grub screw with an over-sized head to secure the guide rod 136A.

140, an angular extension at the distal end of the body of the lever 128 which houses a rigid anchor to secure a flexible cable.

142, the flexible cable that connects the rigid anchor that is between the open channel of the partial disk 144.

144, the disk acts as the point of resistance of the secondary lever.

146, an after market rotary power system comprising of a motor, a rechargeable battery pack, and a RPM controlling unit.

148, a worm gear mounted to the shaft of the motor.

150, a secondary reduction gear to mesh with the worm gear.

152, is a shaft with bearings on the ends. The lower end is anchored to a bearing on the face of the reduction gear. The upper end of the shaft is secured to a similar bearing on one arm of a modified body of a primary lever.

154, is an arch on the caudal end of the modified body of the lever. This arch provides clearance for the reduction gear when the connecting rod is at the bottom of the circular stroke.

156, is another version of the body of the primary lever.

158, a solid stem that is extruded from the top of the hollow plunger 160.

159, is the flanged cap on the top of the hollow plunger body 160.

160, the body of the hollow plunger.

162, is a rigid collar that is attached to the lower rim of the body of the plunger.

164, a machine nut that is secured inside the rigid collar.

166, is a coil spring that slides over the outer surface of the body of the plunger.

167, is the flange on the upper rim of a hollow housing 168 of the plunger unit. This is secured to the under-side of the anterior portion of the top member of the rigid frame.

168, the hollow housing of the plunger unit.

170, a rigid collar that is secured to the bottom rim of the body of the hollow housing. The inside diameter of the rigid collar is smaller than the opening found inside the body of the hollow housing forming an internal lip.

172, a machine screw with a flange near the lower end that courses thru the nut. This setup lets the lifesaver to adjust the height of the dome 174 as needed.

174, a resilient non-metallic user replaceable dome with a scalloped rim on the top edge. A central annular recess on the top surface of the dome receives the lower flanged end of the machine screw.

176, the raised anterior edge on the top of the stem 158.

180, an optional 1.75 inch plunger depth limiting block.

182 A & 182 B, a set of finger grip extrusions on the 1.75 inch blocks.

184, an optional 1.5 inch plunger depth limiting block.

186, a finger grip extrusion on the 1.5 inch block.

188 A & 188 B, a pair of fully articulating hinges for the two blocks.

195 a carrying handle on the primary lever in the two lever configuration.

196, the opening in the body of the lever 109.

198, the ridge going across the body of the lever 109 that is positioned caudal to the raised edge 176 of the stem 158 in the active position.

200, the body of the secondary lever.

202 A & 202 B, the screws to lock the two guide rods 136*a* & 136B.

204, the upper roller bearing of the connecting rod 132.

206, is the shaft of the connecting rod 132.

208, is the lower bearing of the connecting rod that attaches to the secondary lever.

DETAILED DESCRIPTION

FIG. 1A shows the embodiment in a perspective view. The primary lever 109A is in an operational position. An optional after market electronic metronome 117 is mounted on the sloping part of the upright member with hook and loop or similar material for ease of removal or servicing the unit. The sections 102, 107, 116, and 118, comprising the rigid frame are permanently fused. The two handles 112 and 120 have non-slip sleeves or a non-slip coating on the cylindrical parts for improved grip. A pair of plunger depth limiting blocks 114 is in an inactive position.

Figure 1B:
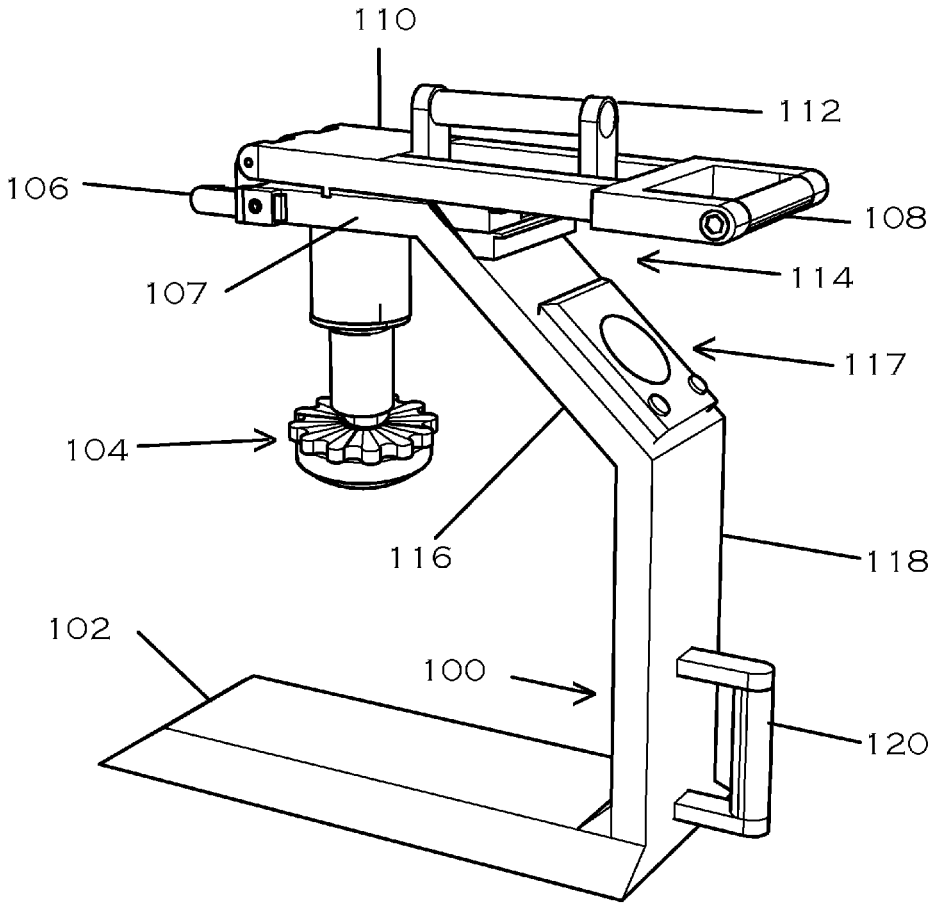
FIG. 1B shows the embodiment with the straight lever in a compressed position.

FIG. 1B shows the same embodiment with the lever 109A in a compressed position wherein the dome of the plunger unit 104 has ventrally traversed the default 2 inches. The carrying handle is seen passing thru the opening in the body 110 of the primary lever 109.

Figure 1C:
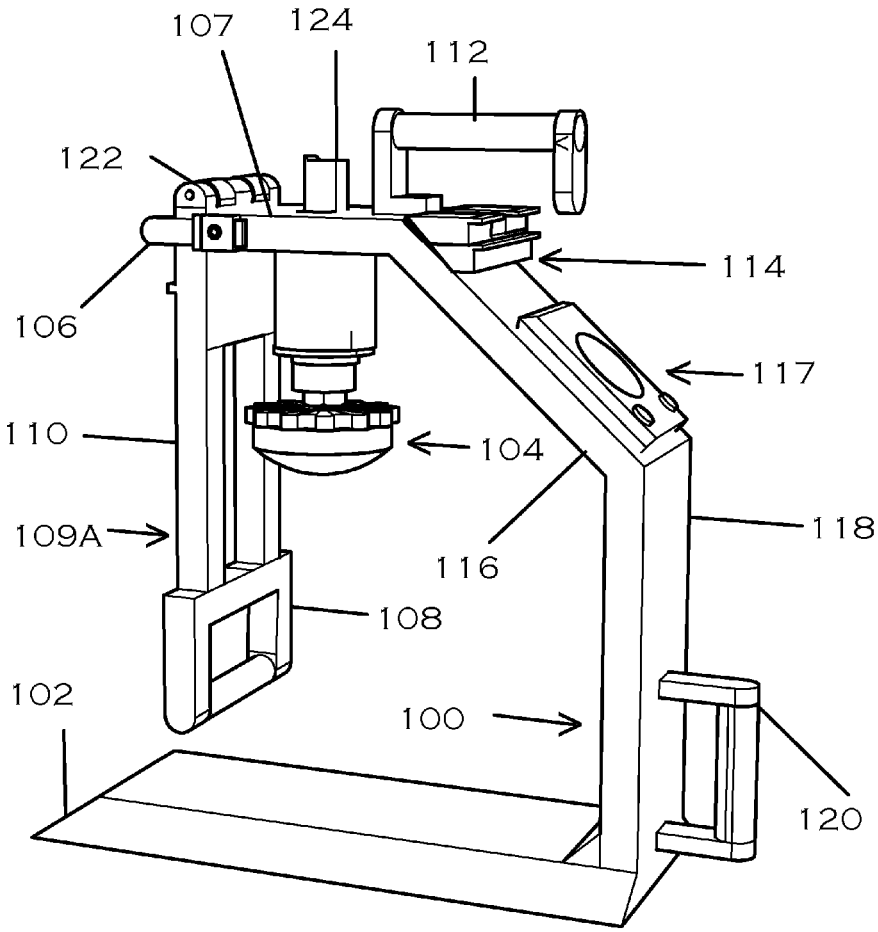
FIG. 1C shows the embodiment with the straight lever in a storage position.

FIG. 1C shows the same embodiment in a storage position. The lever 109A is rotated cranially to assume a ventrally directed vertical position and is held in place by the locking tab 106. This position makes it convenient to carry or transport the embodiment by using the handle 112, or to place in a shelf for storage.

Figure 2A:
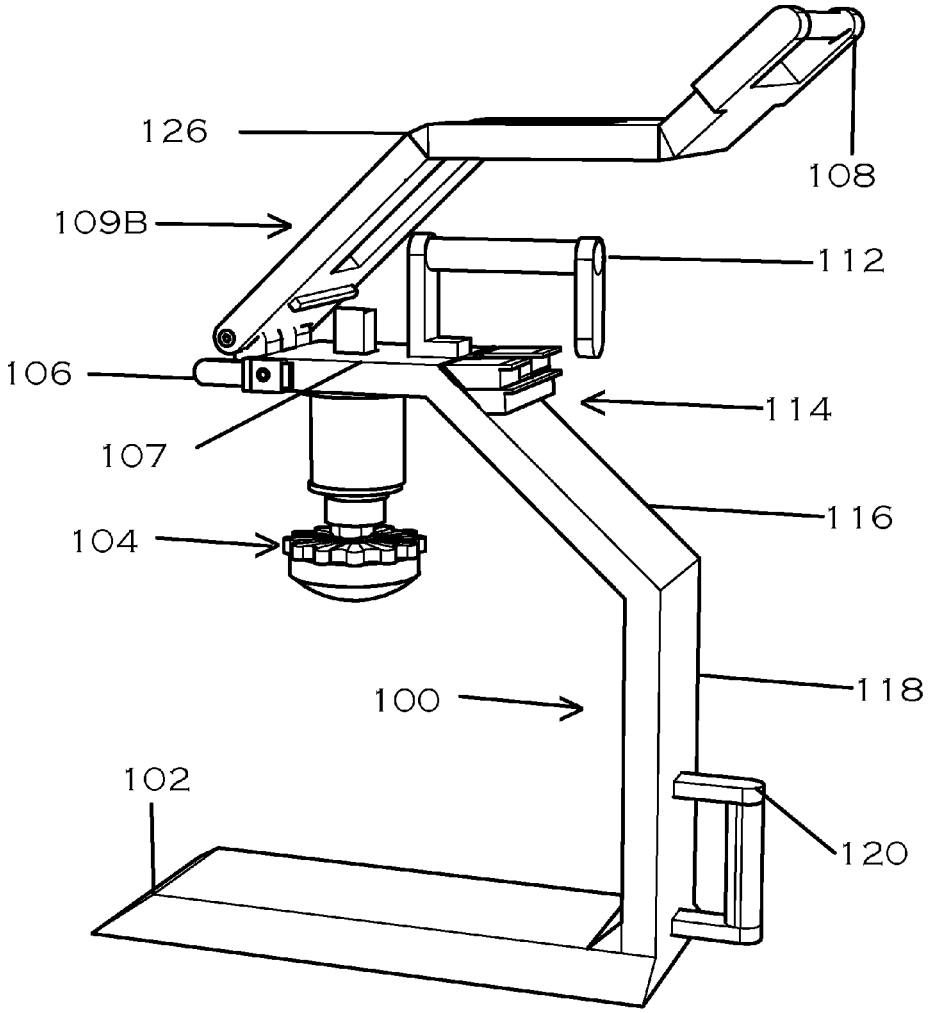
FIG. 2A is another embodiment with a lever configured in a 'Z' shape.

FIG. 2A shows the embodiment with the primary lever 109B modified in the shape of the letter Z. In this configuration the operational height of the handle 108 is lower and is farther away from the hinged attachment 122. This shape brings the operational stroke of the lever 109B to a more ergonomic position and increase the mechanical advantage and as such lesser effort to compress the chest cavity. Pending field trials this is the best mode.

Figure 2B:
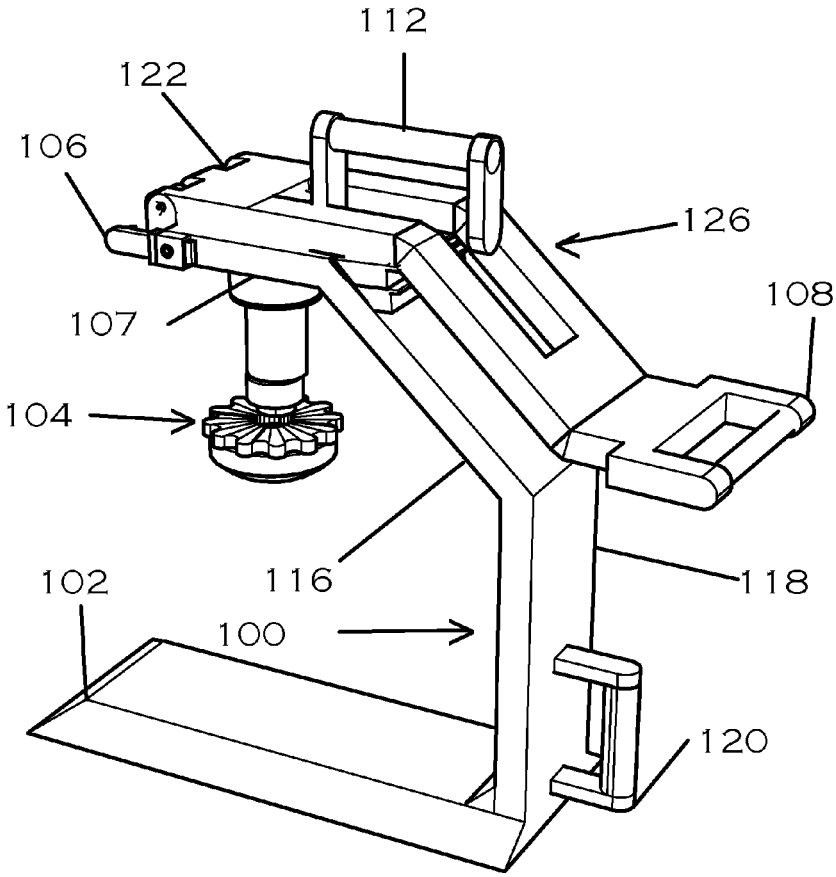
FIG. 2B shows the embodiment with the Z-lever in a downward compressed position.

FIG. 2B is the Z lever embodiment in the compression phase where the dome of the plunger unit 104 has traversed the default two inches.

Figure 2C:
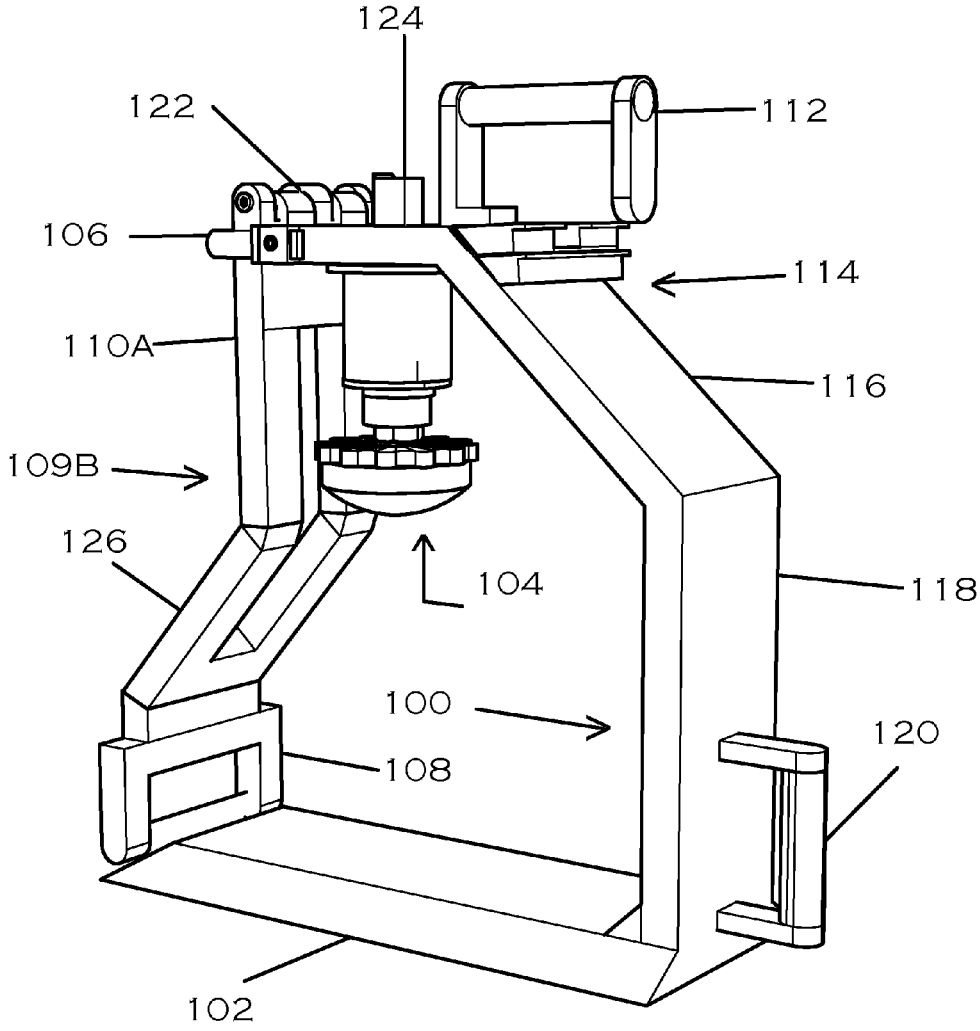
FIG. 2C shows the embodiment with the Z-lever in a storage position

FIG. 2C shows the Z lever embodiment in the storage position with the primary lever 109B rotated cranially to rest in a ventrally directed position.

Figure 3A:
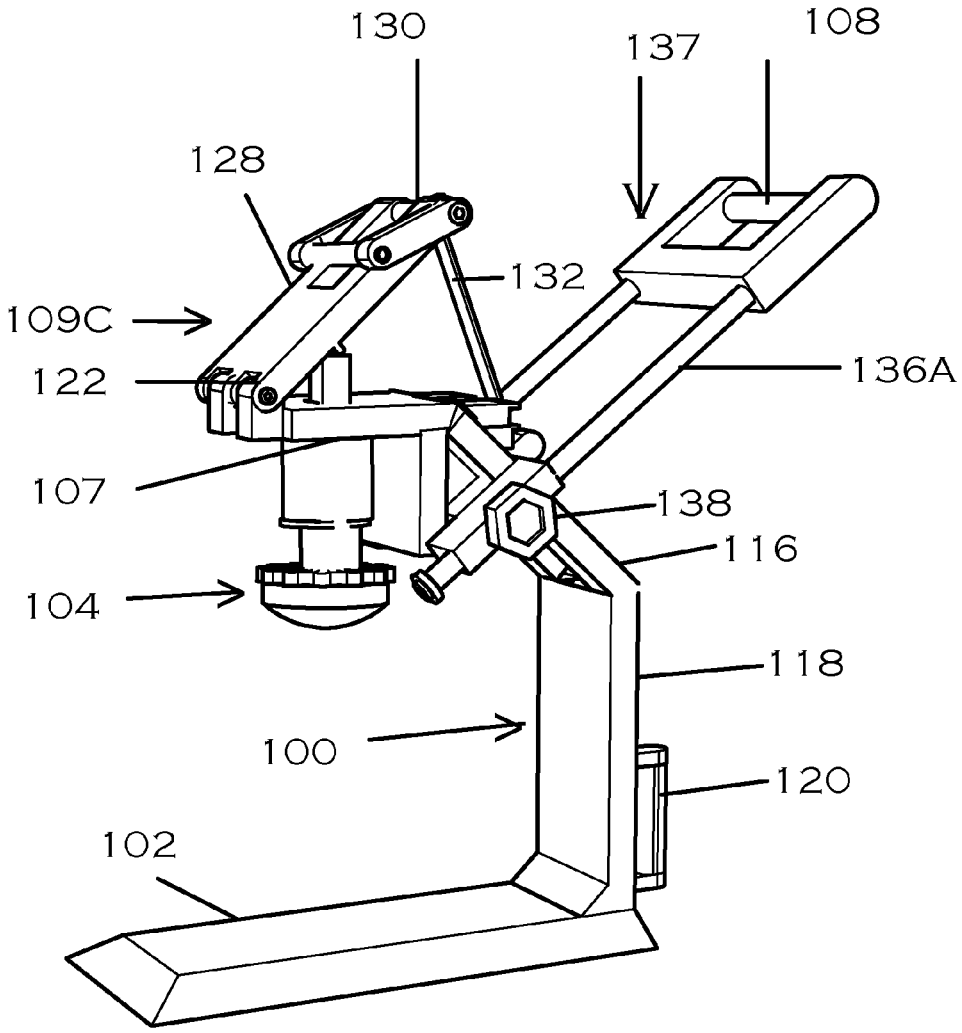
FIG. 3A shows yet another embodiment with two articulating levers.

FIG. 3A is another variation of the embodiment showing a two lever configuration with an effort to further enhance the mechanical advantage. Here the modified primary lever 109C is shortened and sports an articulating handle 130 fixed to the outer edges of the distal end of the lever. The handle 130 is used to carry and transport the embodiment. A rigid connecting rod 132 with hollow bearings on the ends connects the primary lever 109C and the secondary lever 137. The plunger depth limiting blocks 114 are in the inactive position.

Figure 3B:
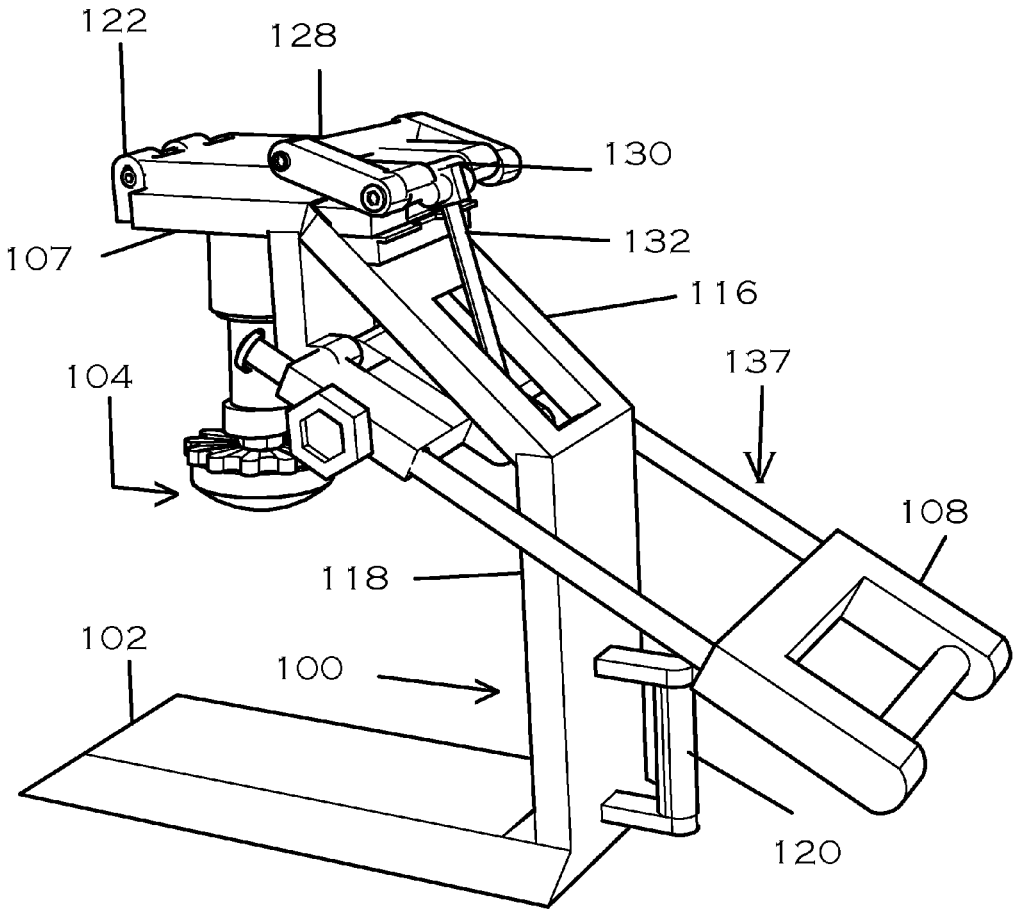
FIG. 3B shows the 2 lever embodiment with the levers in a compressed position

FIG. 3B shows the embodiment with the two lever configuration in a compression phase with the secondary lever handle 108 in the downward position, the primary lever 109C resting over the top member 107 and the dome has plunged two inches ventrally.

Figure 3C:
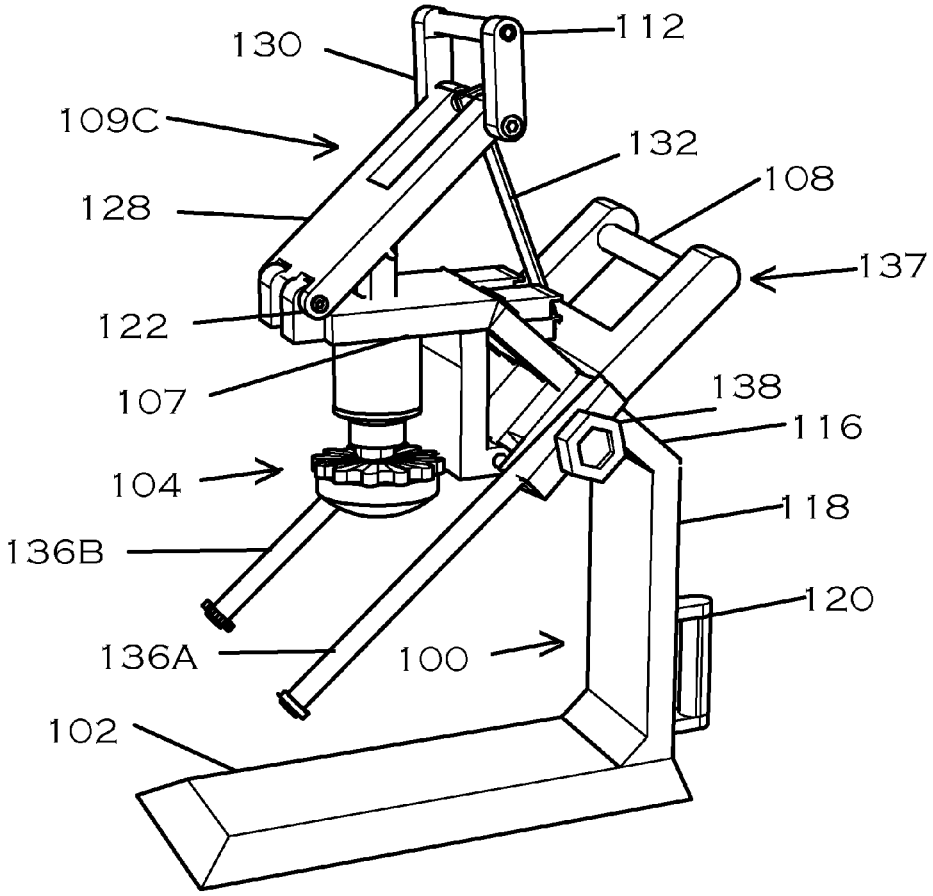
FIG. 3C shows the 2 lever embodiment with the secondary lever in a retracted position.

FIG. 3C shows the two lever configuration in an inactive or storage position with the handle 108 of the secondary lever retracted towards the body.

Figure 4:
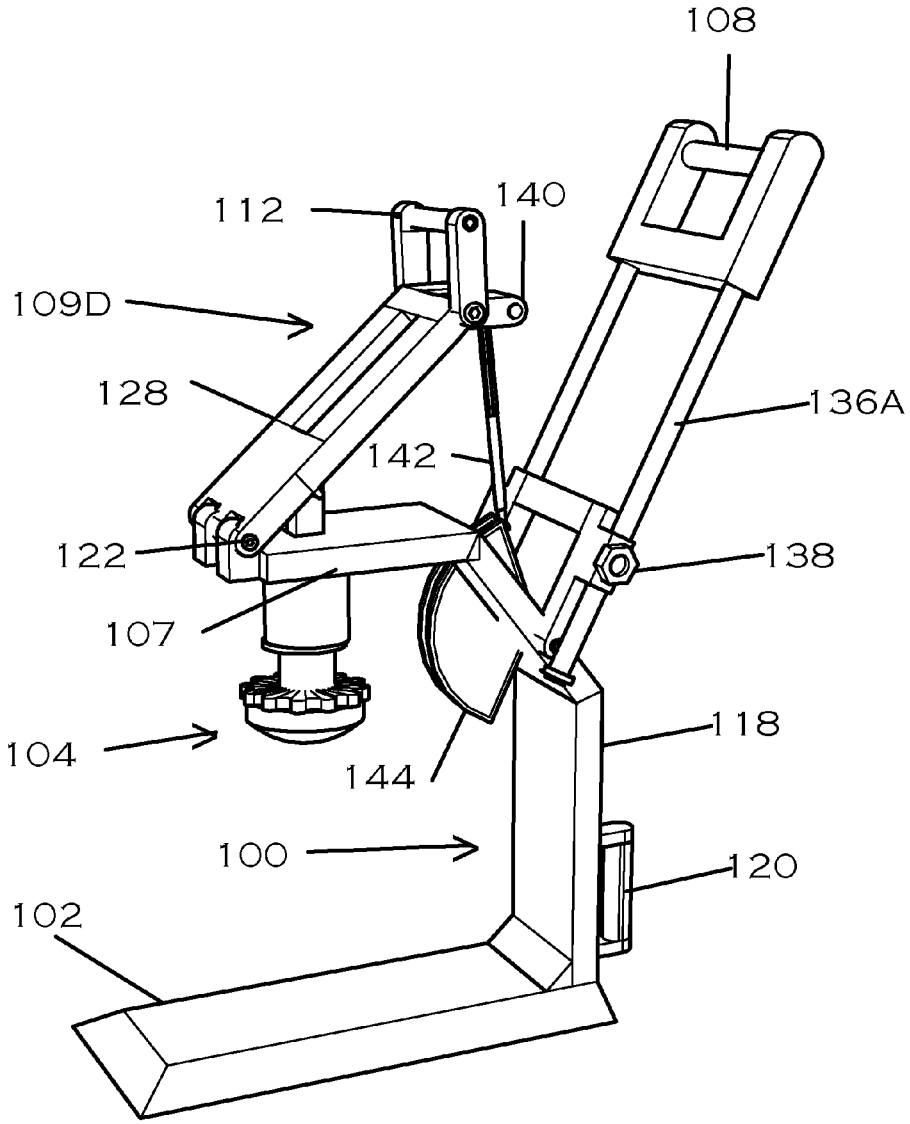
FIG. 4 shows another embodiment with a partial disk in the secondary lever.

FIG. 4 shows another variation of the two lever configuration wherein the distal end of the primary lever 109D is modified to have an anchor point for a flexible cable 142. The body of the secondary lever is replaced with a partial rigid disk 144 that has a groove on the outer edge. The two levers are connected with a flexible cable.

Figure 5:
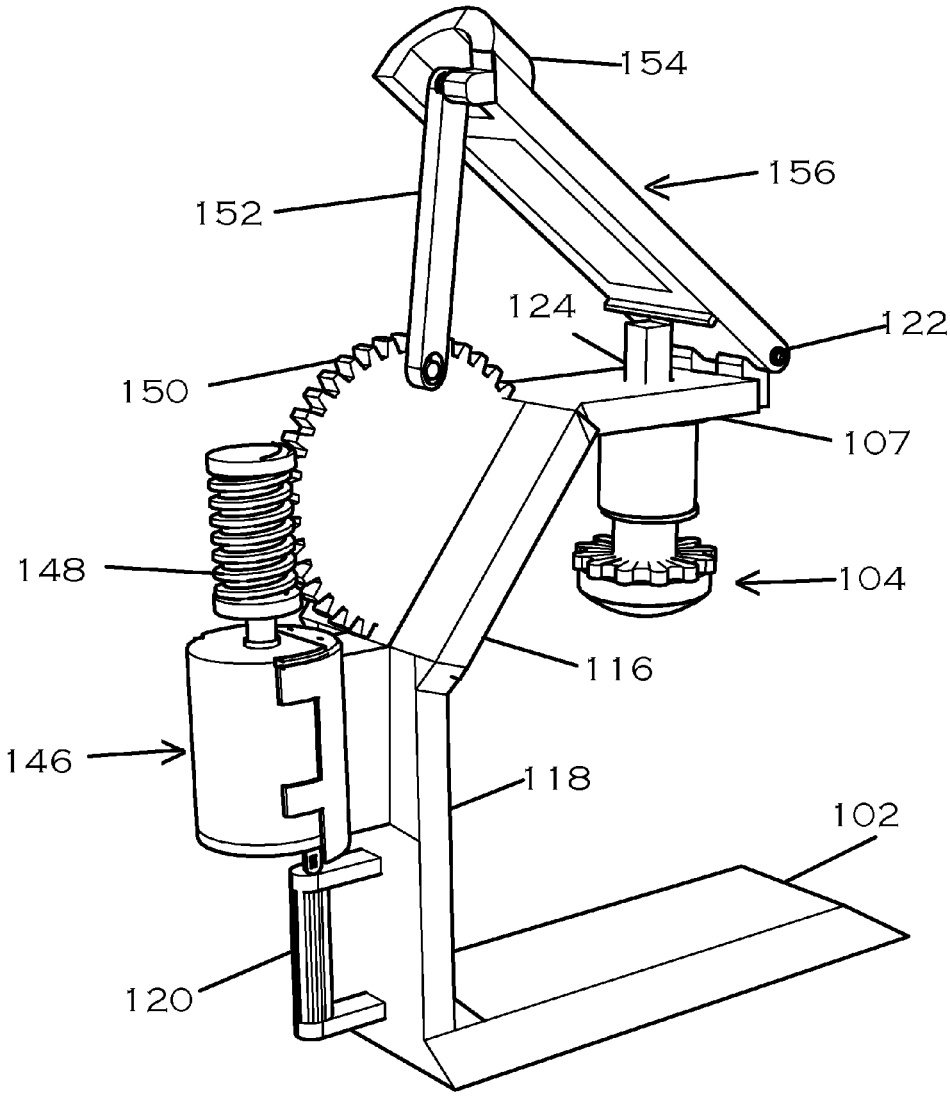
FIG. 5 shows a motorized version of the embodiment

FIG. 5 shows yet another variation of the single lever embodiment wherein the power needed to depress the primary lever 156 is provided by a low speed high torque motor 146. The shaft of the motor has a worm gear 148 and the worm gear meshes with a circular reduction gear 150. This circular gear 150 has a bearing away from the axis on the surface for the attachment of a rigid connecting shaft 152. The connecting shaft attaches to a similar bearing found on the distal end of the modified lever 156.

Figure 6:
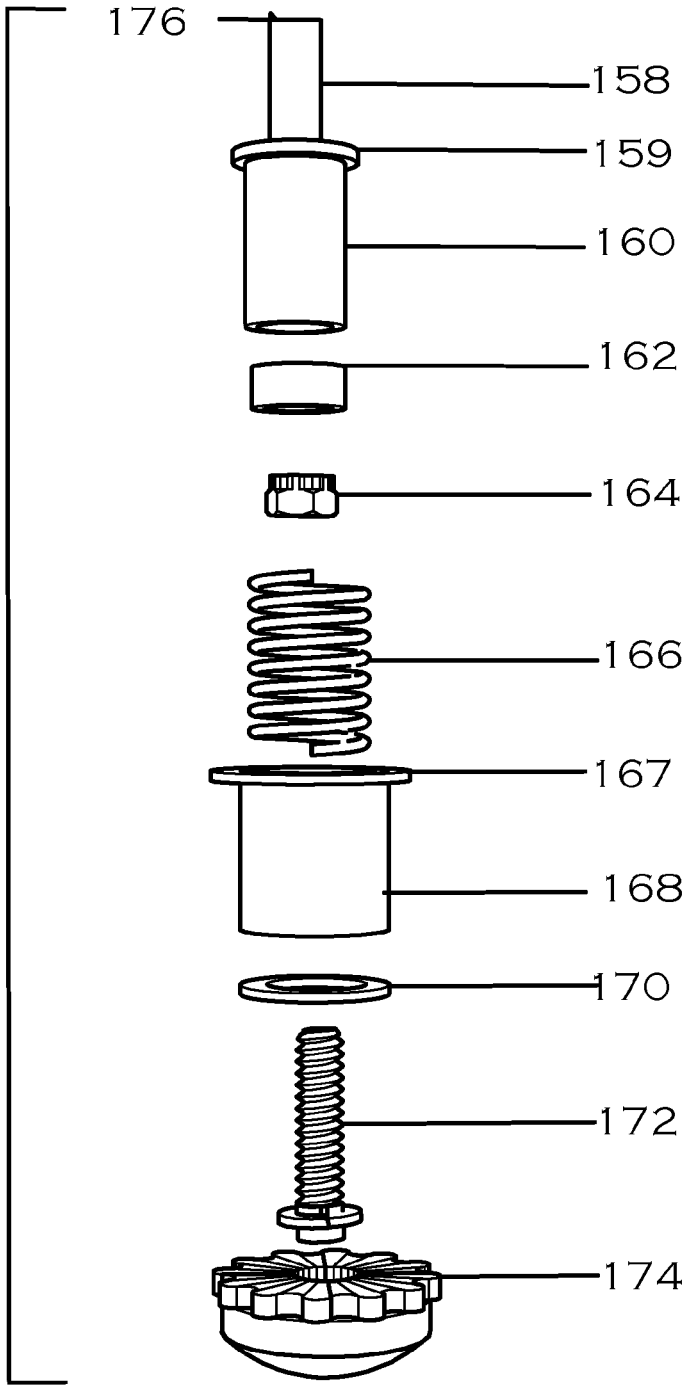
FIG. 6 shows an exploded view of the plunger unit.

FIG. 6 shows the exploded view of the plunger unit. The stem 158 is attached on the top of the flanged cap 159 of plunger 160. The stem 158 shows a raised process 176 on the cranial edge of the top surface. This process when positioned cranial to the ridge 198 of the primary lever prevents metal to metal slippage and the caudal migration of the stem during the compression phase. A rigid collar 162 is attached to the bottom edge of the hollow plunger 160 and serves to secure a machine nut 164 inside it. A coil spring 166 goes around the outside of the body of the hollow plunger and is restrained by the flange 159. The plunger unit with the coil spring around it telescope into the barrel of the plunger housing 168. The housing 168 has a flange 167 on the top edge that is attached to the under side of the top member of the rigid frame. The housing 168 has a restricting collar 170 fixedly attached to the bottom edge of the housing 168. The inner diameter of the collar 170 is the same as the outer diameter of plunger 160 and smaller than the inner diameter of the plunger housing 168. This setup stops the lower end of the coil spring 166. A machine screw 172 travels up and down in the machine nut 164. The lower end of the machine screw is attached to a resilient thermoplastic dome 174. The rim of the dome has a scalloped edge to enhance finger grip. The up and down travel of the machine screw 172 and the attached dome 174 permits the user to set the height of the dome based on the antero-posterior chest dimensions of the subject.

Figure 7:
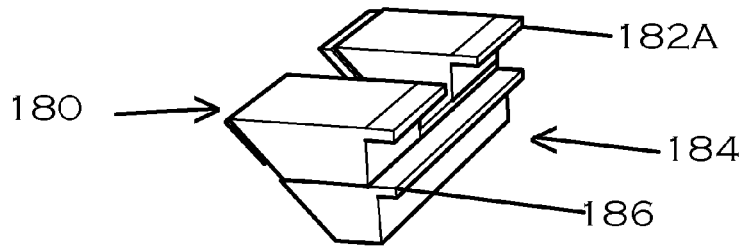
FIG. 7 shows a pair of optional plunger depth limiting blocks.

FIG. 7 shows the plunger depth limiting blocks 114. Blocks 180 are deployed to restrict the plunger to 1.75 inches and block 184, for a depth limit of 1.5 inches. The 1.75 inch blocks have finger grip ridges 182A & 182B and the 1.5 inch block has ridge 186 to be used to rotate them onto the top of the rigid top frame.

Figure 8:
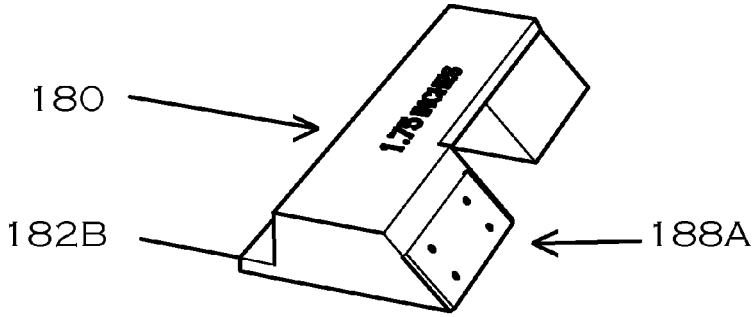
FIG. 8 shows the 1.75 inch depth limiting block.

FIG. 8 shows the 1.75 inch blocks in an operational orientation depicting the label for plunger depth limitations. Hinge leaf 188A is part of the hinge that is attached to the sloping portion of the upright rigid member.

Figure 9:
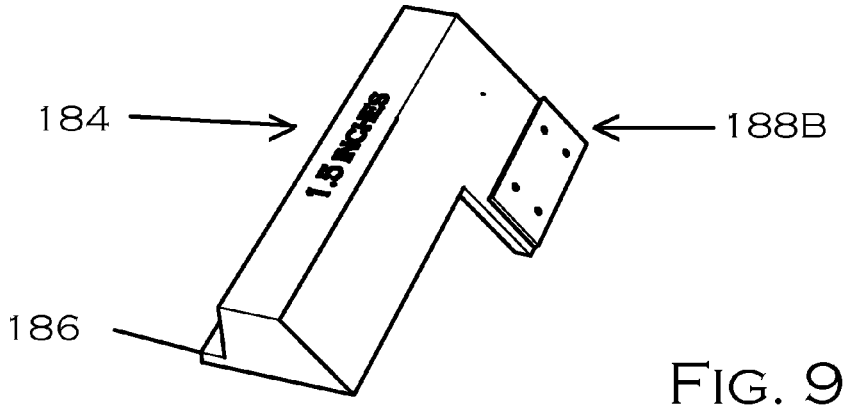
FIG. 9 shows the 1.5 inch depth limiting block.

FIG. 9 shows the 1.5 inch blocks in an operational orientation depicting the labels for plunger depth limitations. Hinge leaf 188B is part of the hinge unit that is attached to the sloping portion of the upright rigid member.

Figure 10:
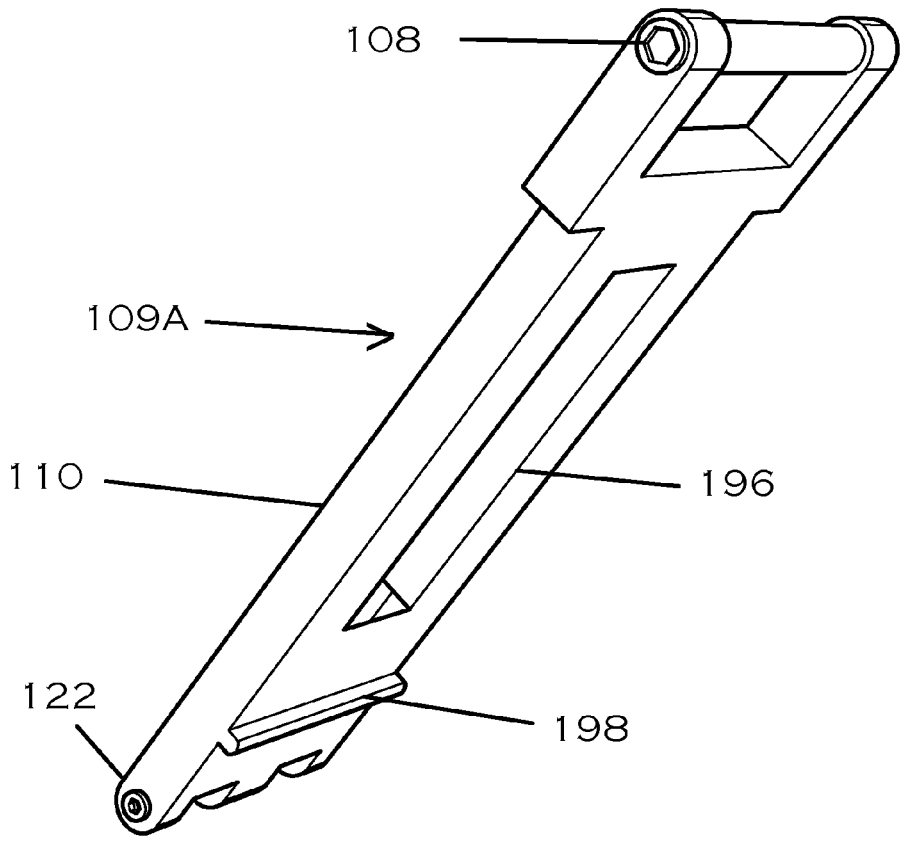
FIG. 10 shows a straight version of the primary lever.

FIG. 10 shows the lever 109A with the articular knuckles 122, the ridge 198, the handle 108 and the open cavity 196 for the clearance of the handle 112 of the top frame.

Figure 11:
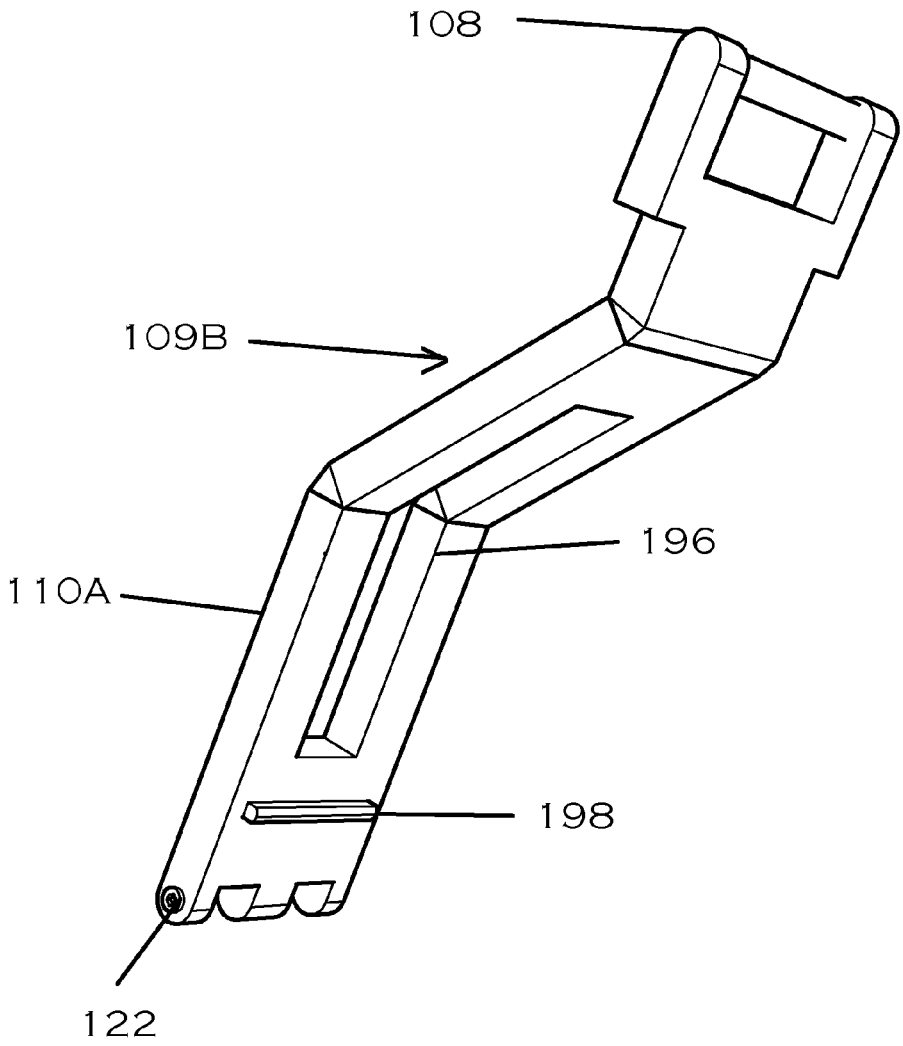
FIG. 11 shows the Z-shape version of the primary lever.

FIG. 11 shows the body 110 of the primary lever 109B in a Z configuration.

Figure 12:
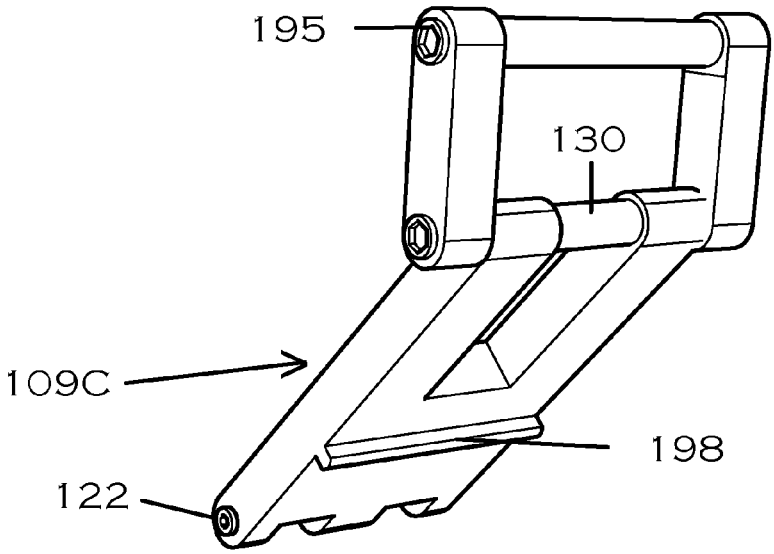
FIG. 12 is a modified version of the straight lever with a handle and transverse bearing.

FIG. 12 shows the primary lever 109C in a two lever configuration

Figure 13:
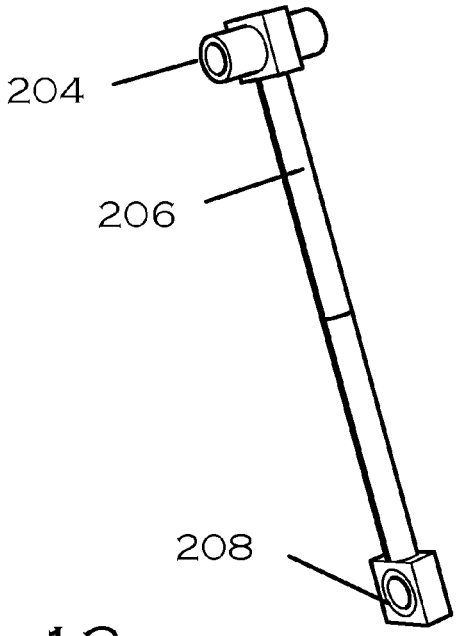
FIG. 13 is a rigid connecting shaft with hollow bearings at the ends.

FIG. 13 shows the rigid connecting rod with a roller bearing 204 at the top end and a hollow bearing 208 at the lower end.

Figure 14:
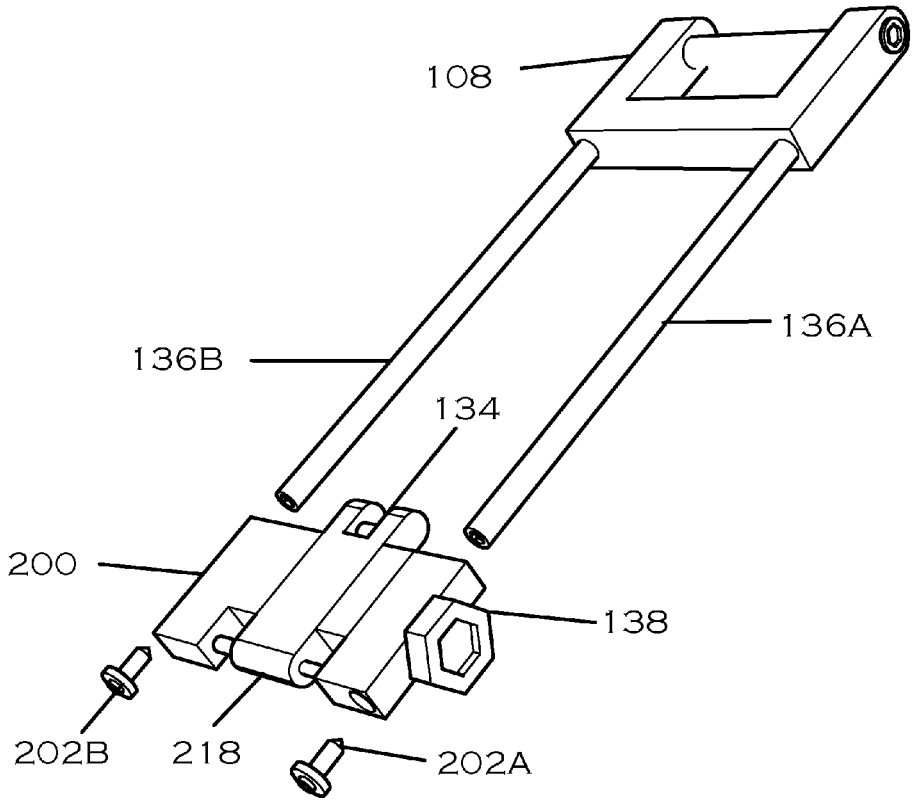
FIG. 14 is a secondary lever with a body, sliding guide rods and a handle.

FIG. 14 shows the secondary lever in the two lever configuration with the handle 108 attached to guide rods and the body of the lever showing the articular processes 218 at the cranial end and a roller bearing 134 at the caudal end.

Operation:

This procedure presumes that the subject is in a supine position on a stable and flat surface. The lever of the embodiment is set in an operational position and the plunger dome is left at maximum height. Using the vertical handle found on the upright member of the rigid frame, the base of the device is slid under and across the chest of the subject. If more room is needed to align the plunger dome over the sternum then the upright member of the device could be positioned between the arm and the side of the chest. In confined quarters the device could also be positioned coming at an angle between the side of the neck and the top of the shoulder such that the sternal pad is over the mid-sternal region. This position also facilitates the exposure and access to the rest of the thoracic region for application of other devices like an AED unit. The dome is unscrewed using the scalloped rim so that the bottom of the dome touches the middle of the sternum. If the subject is adult then no further adjustments are needed and the life-saver could position himself or herself at right angles to the device and by gripping the handle at the end of the lever, start the chest compressions by forcing the lever down and raising it up in a cadent manner. If the subject is not an adult then the optional plunger depth limits are deployed to restrict the compressions to either 1.75 or 1.5 inches. The rate of compressions could be synchronized with an after market electronic metronome set to 100 beats per minute.

MATERIALS, RAMIFICATIONS AND CONCLUSION

The rigid frame and the handles to be made of a light-weight structurally stable metal like aircraft-grade aluminum or similar material. The plunger unit to be made of surgical-grade stainless-steel. The screw and the matching nut with course threading could be made of steel or a stable thermo-plastic material. The user replaceable sternal dome with the scalloped rim on the top edge to be of a resilient thermo-plastic material with a softness of approximately 50 A to 60 A on the Durometer scale. The dome has central annular cavity on the flat top surface to receive the bottom of the machine screw. The articulating hinges of the depth limiting blocks to be of a non-corrosive metal and the blocks to be made of a high-density thermo-plastic material.

In accordance with another embodiment the mechanical advantage of the class 2 levers is enhanced by adding a secondary lever that works parallel to the primary lever. The anterior articular end of the secondary lever is hingedly attached to a set of similar articular processes that is located on the ventral edge of an extruded process on the under side of the caudal end of the rigid top member.

In accordance with another variation of the double lever embodiment, a partial disk with a recessed channel on the outer edge provides the anchor point. The channel provides a path for a flexible cable that connects the two levers.

In accordance with yet another embodiment that uses the same principle as the class 2 levers, but the power needed to activate the lever and thus compress the plunger is supplied by a small low speed high torque motor that is coupled to a worm-gear. The desired revolutions of the final gear are controlled by either a 'Rheostat' or a 'Potentiometer'.

With all the variations shown, the reader will see at least one embodiment of the chest compressor to be less fatiguing to operate and effective in maintaining blood flow to the vital organs during a life-saver CPR procedure. These embodiments are simple in design, light-weight and economical to manufacture. The specificities of the description should not be construed as limitations of the scope of the embodiments but rather as an exemplification of several variations. In keeping with the principle of the class-2 levers, the embodiment can be designed with three levers working in parallel to maximize the mechanical advantage and further reduce the physical effort needed.

I claim:

1. A mechanical device to compress a chest during cardio-pulmonary resuscitation, comprising:

a) a plurality of rigid, fused elongate members forming an open frame adapted to accommodate varied human chest dimensions while a subject is in supine position;

b) a bottom member of said open frame having a free end, a fixable end, and a body in between said free end and said fixable end, said body of said bottom member is adapted to be slidably disposed under and across the chest and held in place by the weight of an upper body of the subject;

c) a top member of said open frame having a hinge end, a fixable end, and a body in between said hinge end and said fixable end, said body of said top member is adapted to be disposed above and across the chest of the subject;

d) an upright member of said open frame adapted to be disposed lateral to said chest, wherein said upright member is fixedly attached to said fixable end of said top member and said fixable end of said bottom member;

e) a lever having a hinge end, a free end, and a body in between the said hinge end and said free end, wherein said body of said top member has a dorsal surface and a ventral surface, said body of said lever is disposed above said dorsal surface of said top member and is hingedly attached to said top member by the mating of the hinge end of the lever and the hinge end of the top member; and f) a vertically oriented plunger unit disposed and fixedly attached to said ventral surface of said top member, said plunger unit coupled with articulation of said lever to provide a means of focal downward pressure, wherein the plunger unit further comprises a slidable hollow plunger inside a hollow housing, said hollow housing having an internal lip on a lower end and a flange on an upper rim, said flange being fixedly attached to an underside of said top member near the hinge end of the top member, said hollow plunger has a body with a flanged cap on an upper end of the body of the hollow plunger, a stem is extruded from a top of said flanged cap, said stem passes thru and protrudes above said body of said top member thru a congruent opening, a nut is fused to a lower end of said hollow plunger, a screw with a fixedly attached resilient dome at a lower end of the screw courses thru said nut and the hollow of the hollow plunger to provide a means of adjusting the height of said resilient dome on a sternum of the subject while in the supine position, a coil spring slides over the body of the hollow plunger and said spring is trapped between the flanged cap of said hollow plunger and said internal lip of said hollow housing, and wherein when said lever is forced down, said resilient dome of said plunger unit is adapted to compress the chest to a predetermined depth and when said lever is raised, said coil spring urges said dome to a neutral position for aiding in chest recoil.

2. The mechanical device of claim 1, wherein said elongate members have a predetermined cross-sectional congruency, an upper region of said upright member is slanted towards the fixable end of the top member, the slanting of the upright member is adapted to follow a natural surface contour of the chest while the subject is in the supine position.

3. The mechanical device of claim 1, wherein said lever has articular processes on said hinge end that mate with complementary articular processes found on the hinge end of the top member to form a hinge joint, said lever has a handle at the free end of the lever, said dorsal surface of the top member has a ridge disposed near to the hinge end of the tope member, said ridge rests on the stem of the plunger unit so that downward force applied to the handle also forces said stem downward.

4. A mechanical device to compress a chest during cardiopulmonary resuscitation, comprising:

a) a plurality of rigid, fused elongate members forming an open frame adapted to accommodate varied human chest dimensions while a subject is in supine position;

b) a bottom member of said open frame having a free end, a fixable end, and a body in between said free end and said fixable end, said body of said bottom member is adapted to be slidably disposed under and across the chest and held in place by the weight of an upper body of the subject;

c) a top member of said open frame having a hinge end, a fixable end, and a body in between said hinge end and said fixable end, said body of said top member is adapted to be disposed above and across the chest of the subject;

d) an upright member of said open frame adapted to be disposed lateral to said chest, wherein said upright member is fixedly attached to said fixable end of said top member and said fixable end of said bottom member;

e) a lever having a hinge end, a free end, and a body in between the said hinge end and said free end, wherein said body of said top member has a dorsal surface and a ventral surface, said body of said lever is disposed above said dorsal surface of said top member and is hingedly attached to said top member by the mating of the hinge end of the lever and the hinge end of the top member; and f) a vertically oriented plunger unit disposed and fixedly attached to said ventral surface of said top member, said plunger unit coupled with articulation of said lever to provide a means of focal downward pressure; and g) a set of articulating plunger depth limiting blocks hingedly disposed on a top end of said upright member, said blocks when deployed by rotating and positioning the blocks on the top member reduce the travel radius of said lever, thereby giving a lifesaver the option of adjusting the predetermined depth of the plunger to accommodate subjects of all ages.

5. The mechanical device of claim 4, wherein said elongate members have a predetermined cross-sectional congruency, an upper region of said upright member is slanted towards the fixable end of the top member, the slanting of the upright member is adapted to follow a natural surface contour of the chest while the subject is in the supine position.

6. The mechanical device of claim 4, wherein said lever has articular processes on said hinge end that mate with complementary articular processes found on the hinge end of the top member to form a hinge joint, said lever has a handle at the free end of the lever, said dorsal surface of the top member has a ridge disposed near to the hinge end of the tope member, said ridge rests on the stem of the plunger unit so that downward force applied to the handle also forces said stem downward.

* * * * *